United States Patent [19]

LaFever

[11] 4,398,448

[45] Aug. 16, 1983

[54] BUFFERED BOLT ASSEMBLY

[75] Inventor: Clifford E. LaFever, Mission Viejo, Calif.

[73] Assignee: The United States of America as represented by the Secretary of the Army, Washington, D.C.

[21] Appl. No.: 288,828

[22] Filed: Jul. 31, 1981

[51] Int. Cl.[3] ..... F41D 11/12

[52] U.S. Cl. ..... 89/185; 89/198

[58] Field of Search ..... 89/166, 172, 185, 198

[56] References Cited

U.S. PATENT DOCUMENTS

| | | | |
|---|---|---|---|
| 3,566,744 | 3/1971 | Stoner | 89/172 |
| 3,748,959 | 7/1973 | Möller et al. | 89/198 |
| 4,240,324 | 12/1980 | Smith et al. | 89/198 |

*Primary Examiner*—Stephen C. Bentley
*Assistant Examiner*—Maureen Ryan
*Attorney, Agent, or Firm*—Robert P. Gibson; Anthony T. Lane; Max Yarmovsky

[57] ABSTRACT

A buffered bolt assembly is disclosed for use in an automatic weapon. A bolt is received in a sleeve on a bolt carrier and is movable therein both axially and rotationally. One or more cam pins on the bolt are received in respective cam guides in the sleeve to control the bolt's rotational position as a function of its axial position. The aft end of the bolt is provided with at least one and preferably two aftward-projecting bolt extensions, for which corresponding slots are provided in the aft surface of the sleeve. When the bolt carrier and bolt are in the battery or firing position, the bolt extensions protrude through their respective slots. The bolt extensions are of such a length that during the recoil stroke of the bolt assembly, the aft ends of the bolt extensions are flush with the rear outer surface of the aft wall of the sleeve. When the rearward motion of the bolt carrier is stopped by the collision of the stationary buffer with the aft surface of the sleeve, the bolt extensions impact the buffer simultaneously with the sleeve, decelerating the bolt at the same rate as the bolt carrier. During the following forward stroke, the buffer also accelerates both the bolt and the bolt carrier simultaneously. As a result, the load on the latch and the cam pins is reduced.

3 Claims, 7 Drawing Figures

FIG. 5A.
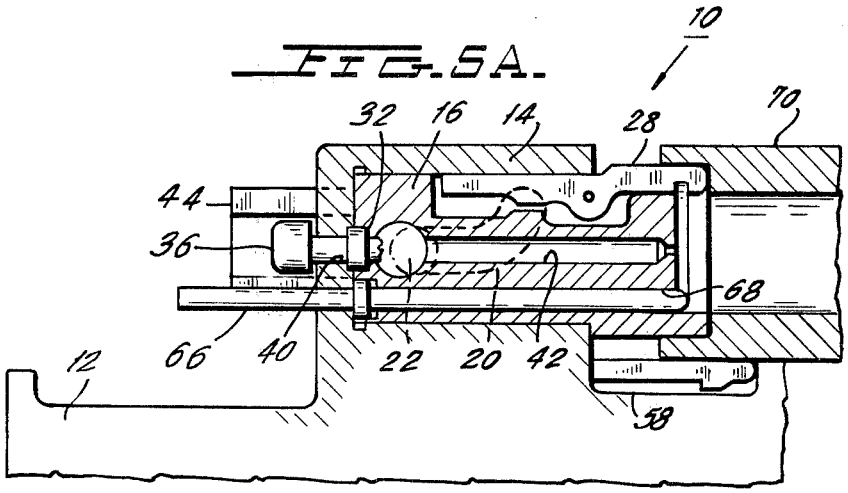
FIG. 5B.
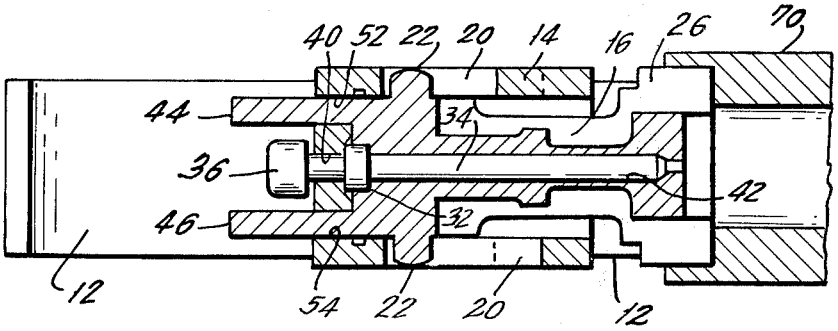
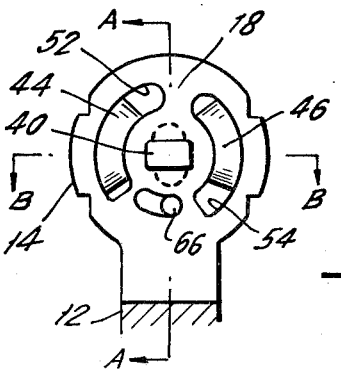
FIG. 2.

BUFFERED BOLT ASSEMBLY

GOVERNMENTAL INTEREST

The invention described herein was made in the course of a contract with the Government and may be manufactured, used and licensed by or for the Government for Governmental purposes without the payment to me of any royalties thereon.

BACKGROUND OF THE INVENTION

The present invention pertains to bolt assemblies, and more particularly pertains to buffered bolt assemblies, of the type used in automatic weapons.

In conventional buffered bolt assemblies, a relatively massive bolt is mounted on a bolt carrier in such a manner as to be both rotatable about its own axis and slidable fore and aft (axially) relative to the bolt carrier. Typically, the bolt has one or more cam pins on it which engage cam guides formed in the bolt carrier, the cam guides being so shaped as to allow the bolt to slide axially only within certain limits and to cause the bolt to rotate about its axis in a predetermined fashion as it slides axially. Thus, the bolt has two extreme positions relative to the bolt carrier: a first position, in which it has a first rotational orientation and a first axial position that is relatively far forward relative to the bolt carrier, and a second position in which it has a different rotational orientation and is farther to the rear relative to the bolt carrier. A buffer, which is spring-biased forward, is disposed to the rear of the bolt and bolt carrier.

The operational cycle of the conventional buffered bolt assembly includes a recoil stroke, in which the bolt carrier is forced to the rear by the recoil of the weapon, and a forward stroke, in which the bolt carrier is driven forward by the spring bias of the buffer. During the recoil stroke, the spent cartridge of a round that has just been fired is ejected, and on the following forward stroke the bolt engages a fresh cartridge that has in the meantime been fed into the chamber position and moves the new cartridge into position for firing. At the end of the forward stroke, inertia carries the firing pin, which is mounted on the bolt carrier, forward to fire the round, completing the cycle. When the bolt carrier is at its forwardmost point, the bolt is in the first, or forward, position described above relative to the bolt carrier. As the bolt carrier begins its rearward movement at the beginning of the recoil stroke, the bolt remains axially stationary in the weapon until the bolt carrier has moved sufficiently far aft to bring it and the bolt into the second relative position described above. This relative movement of the bolt and bolt carrier causes the bolt to rotate, unlocking the bolt from the end of the barrel and bringing a notch or the like on the bolt into axial and rotational alignment with a latch device provided on the bolt carrier. The latch device is biased to engage the notch when this alignment occurs. Thus, at the end of the first part of the recoil stroke, the bolt has been unlocked from the forward end of the weapon chamber and has been secured relative to the bolt carrier by means of the latch device, and by means of the cam pins and cam guides. During the remainder of the recoil stroke, the bolt and bolt carrier move rearward as a unit until the bolt carrier impacts the spring-biased buffer, which decelerates the bolt carrier to a stop. Because of the latch and cam pin connections, the bolt is also brought to a stop simultaneously with the bolt carrier. The compressed spring of the buffer then drives the bolt carrier and the bolt forward for the forward stroke of the cycle. The bolt, as stated above, grasps the newly fed-in cartridge and drives it home into the firing position. The bolt carrier continues moving forward after this has occurred, forcing the bolt to rotate into locking engagement with the back end of the barrel for firing. At the end of the forward stroke, the firing pin, which is supported on the bolt carrier, is carried forward by its inertia against the cartridge, firing the round.

As will be clear from the foregoing description, the latch device and the cam pins are subjected to a very heavy load at the end of the recoil stroke and the beginning of the forward stroke, when the bolt carrier is suddenly brought to a stop and then is propelled forward by the buffer. This tends to shorten the life of the latch device and/or the cam pins, and requires the use of extra-strong designs for these elements.

SUMMARY OF THE INVENTION

It is the principal object of the present invention to provide a buffered bolt assembly in which the cam pins and the latch device, if any, are subject only to relatively small loads.

It is another object of the invention to provide such a buffered bolt assembly in which cam pins and a latch of relatively light construction can be employed.

It is another object of the invention to provide a buffered bolt assembly in which the cam pins and latch will have a longer useful life than in the prior art.

According to the present invention, these objects are attained by providing at least one and preferably two bolt extensions at the aft end of the bolt. Corresponding slots are provided in the aft end of the portion of the bolt carrier which receives the bolt. When the bolt is in its aft position relative to the bolt carrier, the bolt extensions protrude through the slots and the aft end of the bolt proper abuts the interior surface of the aft end of the portion of the bolt carrier in which it is received. When the bolt is in its forward position relative to the bolt carrier, the aft ends of the bolt extensions are exactly flush with the aft surface of the portion of the bolt carrier in which the bolt is received. The surface of the bolt carrier in which the slots are provided is the portion of the bolt carrier which impacts on the buffer at the end of the recoil stroke. As a result of this structure, the aft end of the bolt extensions impacts on the buffer simultaneously with the impact of the bolt carrier. The bolt is thus directly decelerated by the buffer at the same rate as is the bolt carrier. Similarly, at the beginning of the forward stroke, the buffer directly accelerates both the bolt and the bolt carrier simultaneously, at the same rate. The cam pins and the latch device are thus not required to withstand the extraordinary load at the end of the recoil stroke to which they are subject in conventional bolt assemblies. This allows the use of relatively simple, light designs for these elements and increases their useful life.

Other objects and features of the invention will be apparent from the following description and the accompanying drawings.

BRIEF DESCRIPTION OF THE FIGURES

FIG. 2 is a plan view of the aft end of the upper part of the bolt assembly of the embodiment of FIG. 1.

FIGS. 5A and 5B are views corresponding to those of FIGS. 3A and 3B, respectively, showing the bolt assembly of FIG. 1 at the end of the forward stroke, in the firing or battery position.

DETAILED DESCRIPTION OF THE PREFERRED EMBODIMENT

Figure 1:
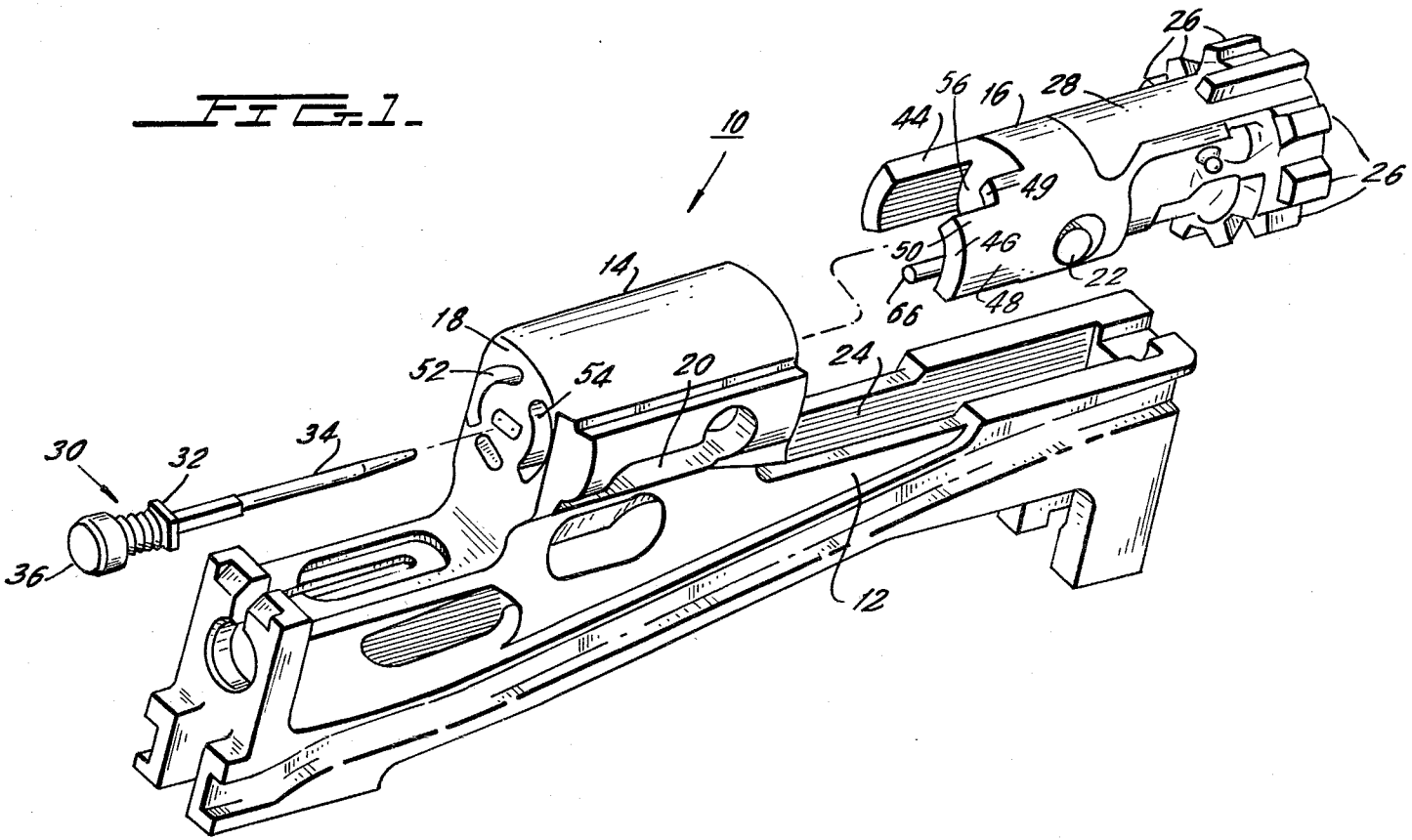
FIG. 1 is a perspective exploded view of one preferred embodiment of the buffered bolt assembly of the invention.

FIGS. 1 and 2 show one preferred embodiment 10 of the invention. A bolt carrier 12 is provided with a portion 14 for receiving a bolt 16. In the embodiment shown, the portion 14 which receives the bolt 16 has the form of a sleeve. The sleeve 14 is open at its forward end to receive the bolt 16, and is closed at its aft end by wall 18. A cam guide 20 is provided in the side wall of the sleeve 14 and receives a cam pin 22 provided on the side of the bolt 16. Preferably, the bolt assembly 10 has a second cam guide and cam pin on the side opposite that shown in FIG. 1. The cam pins 22 and cam guides 20 constrain the bolt 16 to rotate as a function of its axial position relative to the bolt carrier 12. Within the limits imposed by the cam guides 20, the bolt 16 is free to slide axially in the sleeve 14. A longitudinal trough 24 is provided in the forward part of the upper surface of the bolt carrier 12 and extends into the interior of the sleeve 14. The bolt 16 moves both longitudinally and rotationally in trough 24. The forward end of the bolt 16 is provided about its circumference with locking lugs 26. An extractor claw 28 is provided on the top of the bolt 16 for extracting a spent cartridge from the firing position for ejection from the weapon. A firing pin retainer 30, comprising a rectangular plate 32 secured to the aft end of the firing pin 34 and a head 36 joined to the plate 32 by a spring 38 is received in a rectangular aperture 40 in the aft wall 18 of the bolt carrier sleeve 14. Firing pin 34 passes through a central bore 42 in the bolt 16.

According to the invention, the bolt 16 is provided with at least one, and preferably two, bolt extensions 44, 46 extending axially rearward from the aft end of the bolt 16. The transverse cross-section of each bolt extension 44, 46 is preferably a circular arc. In the preferred embodiment shown, one bolt extension 46 preferably has a forward portion 48 whose cross-section comprises a larger circular arc, in degrees, than the cross-section of the aft portion 50. The purpose of this structure is explained below. The aft wall 18 of the sleeve 14 is provided with two slots 52, 54, each of which has the shape of a circular arc, and which respectively receive bolt extensions 44 and 46 when the bolt 16 is located as far aft in sleeve 14 as is permitted by the engagement of cam pins 22 with cam guides 20. In the rearmost position of the bolt 16 in the sleeve 14, the aft surface 56 of the bolt proper abuts the inner surface of wall 18, bolt extensions 44, 46 projecting aft through slots 52, 54, respectively. When the bolt 16 is as far forward relative to the bolt carrier 12 as the cam guides 20 allow, the aft end of each bolt extension 44, 46 is flush with the rear surface of wall 18, for a purpose explained below.

Figure 3A:
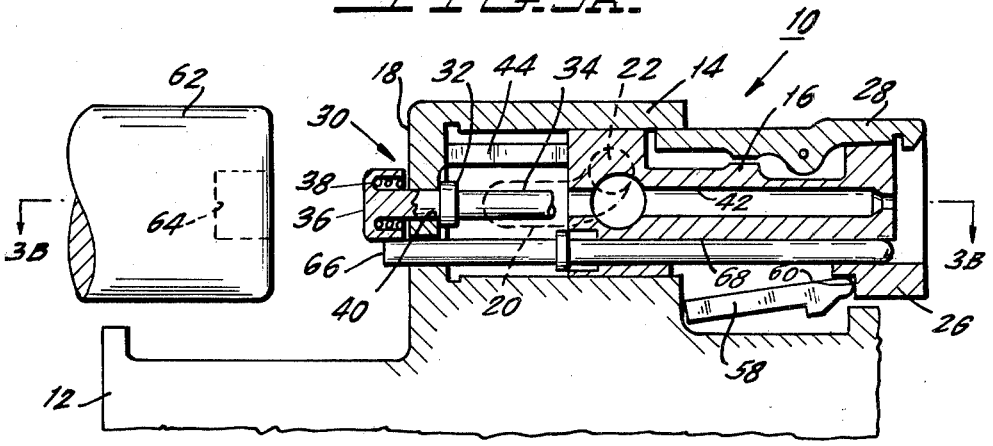
FIGS. 3A and 3B are, respectively, a side view partly in section and a top view partly in section of the embodiment of FIG. 1, showing it during the recoil stroke shortly before impacting the buffer. The views of FIGS. 3A and 3B are taken from section lines A—A and B—B of FIG. 2, respectively. Section line 3B—3B of FIG. 3A also shows the direction of the view of FIG. 3B.
Figure 3B:
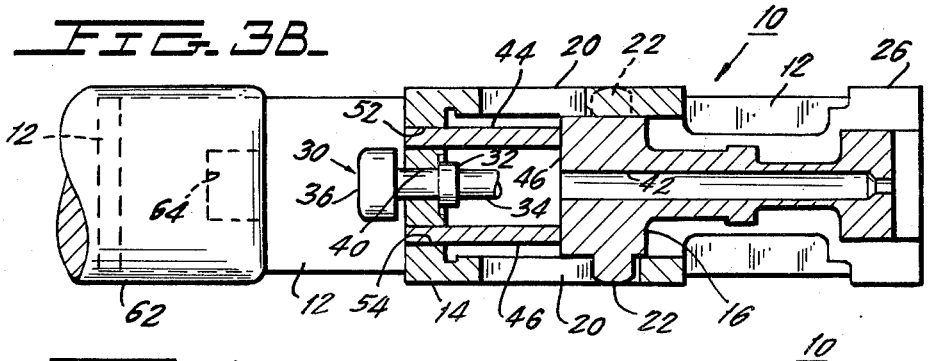

The operation of the buffered bolt assembly of the present invention will now be described with reference to FIGS. 3–5. In FIGS. 3A and 3B, the bolt assembly of the invention is shown part way through the recoil stroke of its cycle of operation. At this point, the bolt 16 is in its forward position relative to the bolt carrier 12, and is held in this position by a latch 58 provided in the upper surface of the bolt carrier 12 and received in a notch 60 in the underside of the bolt 16. The latch 58 is biased into notch 60 by conventional spring means (not shown), and could, as is well known, comprise either a lever like that shown, or a piston element or any other equivalent structure. At this point in the cycle, the cam pins 22 are at the forwardmost point of the cam guides 20. The cooperation between the cam pins 22 and cam guides 20 therefore also bears some of the load involved in maintaining the bolt 16 in its forward position relative to the bolt carrier 12.

Figure 4:
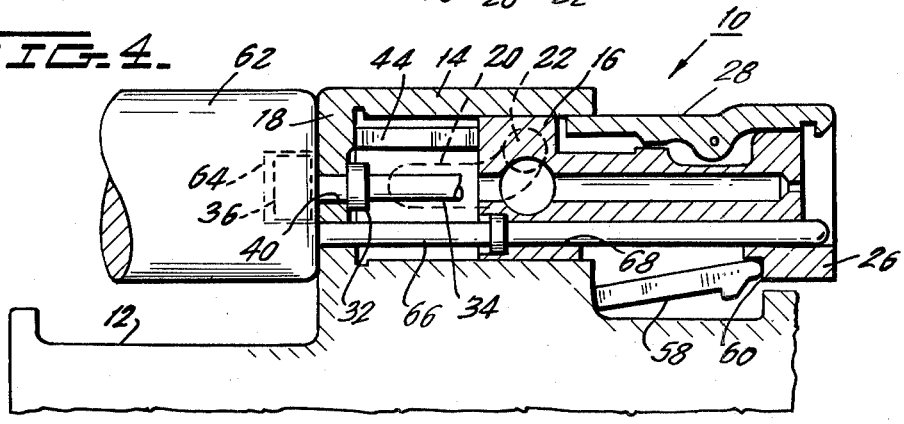
FIG. 4 is a view like that of FIG. 3A, showing the bolt assembly of FIG. 1 as it impacts on the buffer at the end of the recoil stroke.

At the end of the recoil stroke, shown in FIG. 4, the bolt assembly 10 strikes a buffer 62 that is spring biased forward (to the right in the Figures). Specifically, the aft wall 18 of the bolt carrier sleeve 14, and the aft surfaces of the bolt extensions 44, 46, which are flush with the outer surface of wall 18, simultaneously impact on the forward surface of the buffer 62. The buffer is provided with a central well 64 which receives the aft end of the firing pin retainer 30. The ejection rod 66, which is received in an off-center bore 68 in the bolt 16, is pushed forward by the impact against the buffer 62 to release the spent cartridge (not shown) grasped by the extractor claw 28, in a well known manner.

The strong spring bias of the buffer 62 decelerates the bolt carrier and brings it to a stop. Because the aft surfaces of the bolt extensions 44, 46 are flush with that of the wall 18 of the bolt carrier sleeve 14, the buffer 62 also directly decelerates the bolt 16, at the same rate as it does the bolt carrier 12. As a result, only a relatively small load is imposed on either the cam pins 22 or the latch 58. In the conventional type of buffered bolt assembly, lacking bolt extensions 44 and 46, the bolt would simply be decelerated as a result of its connection to the bolt carrier via the cam pins and the latch, resulting in a great strain being imposed on these elements. Because only a small load is imposed on the latch and cam pins in the bolt assembly of the invention, however, they can be made relatively light and simple in construction. In addition, their expected useful life is greatly increased.

Having brought the bolt 16 and bolt carrier 12 to a stop, the spring-biased buffer 62 propels them forward with great force. This is the forward stroke of the cycle. Again, because the aft surfaces of the bolt extensions 44 and 46 are flush with that of the wall 18, both the bolt 16 and the bolt carrier 12 are directly accelerated by the buffer 62 itself, so that no large load is imposed on the cam pins 22 or the latch 58. In prior art bolt assemblies, the latch and cam pins would have to bear the entire load of accelerating the massive bolt. As the bolt assembly moves forward (to the right in the Figures), the forward end of the extractor claw 28 engages the rim of a newly fed in cartridge (not shown) in a well known manner. The forward moving bolt assembly rams the new cartridge into the barrel, the aft end of which is indicated schematically as 70 in FIG. 5A. As is well known, the aft end of the barrel 70 is provided with lug nuts that engage and lock with the lug nuts 26 of the bolt 16 when the forward end of the bolt 16 reaches the aft end of the barrel 70. Once this has occurred, the bolt 16 has moved as far forward as it can. The bolt carrier 12, however, continues to move forward until it reaches the end of its travel, as in conventional bolt assemblies. The relative axial movement of the bolt carrier 12 and bolt 16 causes the bolt 18 to assume its rear position relative to the bolt carrier 12, as shown in FIGS. 5A and 5B, being rotated by the cooperation of cam pins 22 and cam guides 20 in the process. The latch 58 is designed so that as the bolt carrier 12 continues to move forward while the bolt 16 is held axially stationary by the end of the barrel 70, the latch 58 disengages from notch 60, in a well known manner. The rotation of the bolt 16 as the bolt carrier 12 continues forward causes the forward lugs 26 of the bolt 16 to lock with those of the barrel 70, sealing the aft end of the latter and readying the weapon for firing. When the bolt 16 has been locked to the barrel 70, the firing pin is carried forward by inertia and fires the round in a known manner.

In the preferred embodiment, one bolt extension 46 has an axially forward portion 48 that is subtended by a larger angle than the aft portion 50 of the bolt extension 46, defining a fail-safe step 49. In the event that the bolt 16 for any reason fails to fully rotate and lock properly with barrel 70 during the forward stroke, the fail-safe step 49 collides with the interior of wall 18 of sleeve 14, preventing the bolt carrier 12 from completing its forward travel. This in turn prevents the firing pin from striking the cartridge and so prevents the weapon from firing.

From the foregoing description it will be clear that the provision of the novel bolt extensions 44, 46 at the aft end of the bolt 16 makes it unnecessary for either the latch 58 or the cam pins 22 to bear the large load to which they are subjected at the end of the recoil stroke and the beginning of the forward stroke in conventional bolt assemblies. As a result of the present invention, the cam pins and the latch can be made lighter in construction than in conventional bolt assemblies, and the complex latch designs required conventionally can be dispensed with. The useful life of the cam pins and latch is also increased by the use of the novel bolt assembly described herein.

The present invention may be embodied in other specific forms without departing from the spirit or essential attributes thereof and, accordingly, reference should be made to the appended claims, rather than to the foregoing specification, as indicating the scope of the invention.

What is claimed is:

1. A buffered bolt assembly, comprising:

a bolt having a forward end, an aft end, and having bolt extension means extending aft from said aft end, said bolt operatively disposed in said assembly in first and second axial positions, said bolt includes;

two bolt extensions each having a respective cross section having the shape of a respective circular arc;

cam pin means disposed thereon; and a bolt carrier having a bolt carrier sleeve, said bolt carrier sleeve having an open forward end, said bolt being received in said open forward end; and said bolt carrier sleeve having an aft end and having slot means formed in its said aft end for allowing said bolt extension means to extend through said aft end of said bolt carrier sleeve, said slot means comprises two slots which receive respective extensions of said bolt, said bolt extension means extending through said slot means when said bolt is in said first axial position and the aft end of said bolt extension means being flush with the outer aft surface of said bolt carrier sleeve when said bolt is in said second axial position, which includes;

a latch operatively disposed therein for latching said bolt in said second axial position;

cam guide means disposed therein, said cam pin means being received in said cam guide means, for guiding said bolt between first and second rotational positions; said bolt being in said first rotational position when it is in said first axial position and in said second rotational position when it is in said second axial position.

2. The assembly of claim 1, wherein one said bolt extension has an axially forward portion whose cross-section subtends a first circular arc and an axially aft portion whose cross-section subtends a second circular arc that is less than said first circular arc, said forward portion defining a fail-safe step.

3. The assembly of claim 2, wherein said forward and aft portions of said one bolt extension each have a respective upper edge and a respective lower edge, and wherein their respective said lower edges are flush with each other.

* * * * *